US005228904A

United States Patent [19]

Koen

[11] Patent Number: 5,228,904

[45] Date of Patent: Jul. 20, 1993

[54] INFRA RED IGNITION METHOD FOR ORE SINTERING PROCESS

[75] Inventor: Wessel C. Koen, Kuruman, South Africa

[73] Assignee: Samancor Limited, Johannesburg, South Africa

[21] Appl. No.: 906,477

[22] Filed: Jun. 30, 1992

[51] Int. Cl.[5] ..... C22B 4/00

[52] U.S. Cl. ..... 75/751; 75/10.13

[58] Field of Search ..... 75/10.13, 751

[56] References Cited

U.S. PATENT DOCUMENTS

| | | | |
|---|---|---|---|
| 3,148,971 | 9/1964 | Macdonald | 75/10.13 |
| 4,577,838 | 3/1986 | Mathiesen | 75/751 |
| 4,814,003 | 3/1989 | Bergner | 75/10.13 |

*Primary Examiner*—Peter D. Rosenberg

*Attorney, Agent, or Firm*—Jacobson, Price, Holman & Stern

[57] ABSTRACT

A method and apparatus for sintering a mixture of finely divided ore and a solid reductant, preferably in agglomerated form, includes heating the mixture on a hearth (6) with radiant energy in the form of infra red radiation from an infra red source such as infra red lamps (4, 5) to a sufficient temperature to induce ignition of the reductant. The hearth (6) is formed by a moving perforated conveyor surface (2) in which the material to be sintered is disposed for heating by the lamps. Below the hearth is a duct (3) connected to a vacuum source for drawing air through the hearth and material thereon.

19 Claims, 1 Drawing Sheet

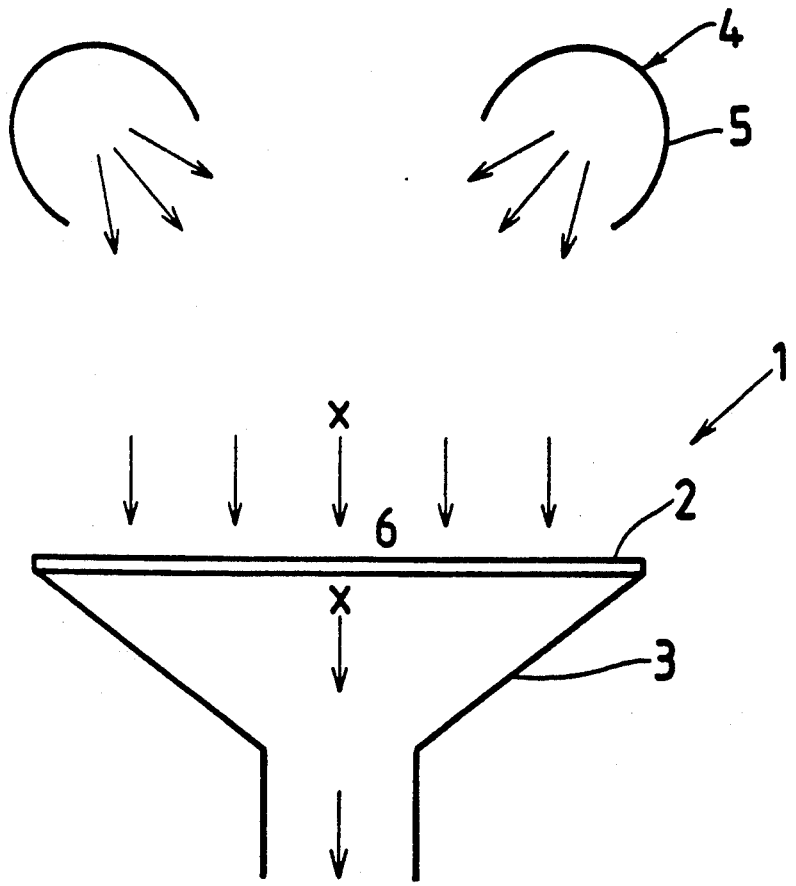
4
5
1
X
6
2
X
3

INFRA RED IGNITION METHOD FOR ORE SINTERING PROCESS

BACKGROUND OF THE INVENTION

This invention relates to an ignition method for the sintering of mixtures of finely divided metal ores and suitable reductants, preferably with the mixtures being in an agglomerated form.

While this invention will be described with particular reference to the sintering of manganese ore products, this should not be construed as limiting the invention or its application in any way.

It is common practice to agglomerate a mixture of finely divided manganese ore and coke by pelletizing for example.

After the pelletizing process, the green pellets are placed on a suitable furnace hearth and ignited using a suitable fuel such as fuel oil, furnace waste gas, liquid petroleum gas or coke breeze. Air is drawn through the agglomerated material and the heat produced by the ignited material sinters it to a lumpy product.

Problems experienced with the process are temperature control and difficulty in directing the heat to the desired point of application.

An object of the invention is to provide an ignition method in which these problems are, at least, decreased.

SUMMARY OF THE INVENTION

According to the invention, a method of igniting a mixture of finely divided ore and a suitable solid reductant including heating the mixture with radiant energy to a sufficient temperature to induce ignition of the reductant.

Further, according to the invention, the mixture is an agglomerated mixture and may be in the form of pellets.

Still further, according to the invention, the radiant energy is infra red energy and preferably short wave radiant energy.

According to another aspect of the invention, sintering apparatus includes a sintering hearth for the location of material to be sintered, and a radiant energy source directed towards the hearth.

Further, according to this aspect of the invention, the hearth is a moving hearth.

Still further, according to the invention, the radiant energy source is an infra red radiant energy source including at least an infra red lamp.

Still further, according to the invention, the infra red lamps include cooling means.

Still further, according to the invention, the hearth includes means for providing a downwardly directed air flow through any material thereon for sintering only or for sintering and cooling.

Still further, according to the invention, the apparatus includes control means for controlling the radiant energy source.

BRIEF DESCRIPTION OF THE DRAWING

One embodiment of the invention described by way of example only follows with reference to the accompanying diagrammatic drawing depicting a sintering hearth in schematic cross sectional end elevation.

DETAILED DESCRIPTION OF THE DRAWING

In this embodiment of the invention, an apparatus and process for the sintering of manganese ore is described.

The apparatus (1) comprises a moving conveyor surface (2) of the type normally used in continuous sintering operations. The characteristics of the conveyor are thus that it is heat resistant and is perforated to allow for the passage of air therethrough. Conveniently the conveyor is a metal "chain" type conveyor.

Beneath the conveyor is means for drawing air through the conveyor and any material thereon, the means including a suction duct member (3) immediately below the conveyor which communicates with a vacuum apparatus (not shown). In this way, an air flow in direction X is created.

Above the conveyor (2) are a plurality of short wave infra red lamps of 2 kWatts each. These lamps (4) include reflectors (5) for directing radiant energy onto the hearth (6) of the apparatus formed by the conveyor surface. Preferably the output of the lamps may be controlled by control means which is not shown.

In use, a mixture of finely divided manganese ore and coke, which has been pelletized, is continuously fed onto the conveyor (2) which moves the material through the hearth (6) of the apparatus.

In the hearth, the radiant energy from the short wave infra red lamps impinges on the upper surface of the mass of green pellets, thereby heating them to the point of ignition of the coke. The air flow through the pellets not only aids in the ignition process, but ensures that the coke burns all the way through the bed of material, thereby ensuring complete sintering of the pelletized mass.

It will be appreciated that not only can the amount of infra red radiation be controlled, but the radiant energy may be optimally directed to the point on the pelletized mass where ignition must take place.

Other embodiments are envisaged within the scope of the invention, including other types and configurations of the apparatus and method, as well as its application to other types of ores.

I claim:

1. A method of igniting a mixture of finely divided ore and a suitable solid reductant for sintering the ore comprising:

heating the mixture with radiant energy to a sufficient temperature to induce ignition of the reductant.

2. A method as claimed in claim 1 and further comprising:

agglomerating said mixture to form an agglomerated mixture.

3. A method as claimed in claim 2 and further comprising:

pelletizing said agglomerated mixture.

4. A method as claimed in claim 1 and further comprising:

heating said mixture with short wave radiant energy.

5. A method as claimed in claim 4 and further comprising:

heating said mixture with infra red energy.

6. Sintering apparatus comprising:

a sintering hearth for the location of material to be sintered; and a radiant energy source directed towards said hearth so that radiant energy from said source impinges on material on said hearth for heating said material.

7. Sintering apparatus as claimed in claim 6 wherein: said hearth comprises a moving hearth.

8. Sintering apparatus as claimed in claim 6 wherein: said radiant energy source comprises an infra red radiant energy source.

9. Sintering apparatus as claimed in claim 8 wherein:
said infra red radiant energy source comprises at least an infra red lamp.

10. Sintering apparatus as claimed in claim 8 wherein:
said infra red radiant energy source further comprises cooling means therefor.

11. Sintering apparatus as claimed in claim 7 wherein:
said hearth further comprises means for providing downwardly directed air flow through any material thereon.

12. Sintering apparatus as claimed in claim 11 and further comprising:
control means for controlling said radiant energy source.

13. Sintering apparatus as claimed in claim 7 wherein:
said radiant energy source comprises an infra red radiant energy source.

14. Sintering apparatus as claimed in claim 13 wherein:
said infra red radiant energy source comprises at least an infra red lamp.

15. Sintering apparatus as claimed in claim 14 wherein:
said infra red radiant energy source further comprises cooling means therefor.

16. Sintering apparatus as claimed in claim 15 wherein:
said hearth further comprises means for providing downwardly directed air flow through any material thereon.

17. Sintering apparatus as claimed in claim 16 and further comprising:
control means for controlling said radiant energy source.

18. Sintering apparatus as claimed in claim 16, wherein said means for providing downwardly directed airflow comprises:
a perforated conveyor on said hearth for supporting said material to be sintered thereon; and
duct means below said hearth and associated therewith and communicating with a vacuum means for drawing air through said material on said conveyor.

19. The method as claimed in claim 3 and further comprising:
supporting said pelletized mixture on a perforated hearth surface;
heating said pelletized mixture with short wave infra red radiant energy; and
drawing air through said pelletized mixture on said perforated hearth surface, so that said infra red energy ignites said reductant and the heat from the ignited reductant sinters said ore.

* * * * *